US009604115B2

(12) United States Patent
Wood et al.

(10) Patent No.: US 9,604,115 B2
(45) Date of Patent: Mar. 28, 2017

(54) EXERCISE/TRAINING MACHINE

(71) Applicant: Tonus Sport Pty Ltd, New South Wales (AU)

(72) Inventors: Scott Wood, Budgewoi (AU); Craig Andrews, Kirribilli (AU); Sam Deal, Kirribilli (AU); Sascha Patschenko, Kirribilli (AU); Jorge Prats, Riveredge, NJ (US)

(73) Assignee: Tonus Sport Pty Ltd, New South Wales (AU)

( * ) Notice: Subject to any disclaimer, the term of this patent is extended or adjusted under 35 U.S.C. 154(b) by 13 days.

(21) Appl. No.: 14/521,489

(22) Filed: Oct. 23, 2014

(65) Prior Publication Data

US 2015/0141223 A1 May 21, 2015

Related U.S. Application Data

(63) Continuation-in-part of application No. PCT/AU2013/000423, filed on Apr. 23, 2013.

(30) Foreign Application Priority Data

Apr. 24, 2012 (AU) ..... 2012901612

(51) Int. Cl.
*A63B 22/14* (2006.01)
*A63B 69/00* (2006.01)
(Continued)

(52) U.S. Cl.
CPC ..... *A63B 69/0093* (2013.01); *A63B 21/018* (2013.01); *A63B 21/0552* (2013.01);
(Continued)

(58) Field of Classification Search
CPC ..... A63B 69/0093; A63B 2069/068; A63B 22/18; A63B 22/16; A63B 22/018;
(Continued)

(56) References Cited

U.S. PATENT DOCUMENTS 2,365,468 A 12/1944 Herold
4,132,405 A 1/1979 Asher
(Continued)

FOREIGN PATENT DOCUMENTS

DE 102009033440 A1 1/2011
EP 0917890 A2 5/1999
(Continued)

OTHER PUBLICATIONS

Cheney, A. 'Surfs Up Inside the Gym' Wall Street Journal, (online), Dec. 7, 2011, (retrieved on Sep. 7, 2013) retrieved from the internet <URL: http://web.archive.org/web/20120108031540/h ttp://online.wsj.com/article/SB10001424052970204770404577080342333234820.html>.
(Continued)

*Primary Examiner* — Loan H Thanh
*Assistant Examiner* — Megan Anderson
(74) *Attorney, Agent, or Firm* — Thrive IP; Bernard S. Klosowski, Jr.

(57) ABSTRACT

A device suitable for providing a workout for surfers and as a general exercise device includes a platform on which a user may kneel, sit, lie, or stand. The platform is mounted on a support frame including legs for supporting the top of the frame above ground level. A rod is mounted on the support frame and extends away from the platform. At least one resistance and a handle are provided on the rod, which can be grasped by a user and pulled against the resistance. The platform is mounted on the support frame by a mounting which allows the platform to tilt, particularly laterally from side to side about an axis which is parallel or co-axial to the axis of the rod. The mounting is adjustable to allow the degree of instability of the platform to be adjusted.

15 Claims, 18 Drawing Sheets

(51) Int. Cl.

| | |
|---|---|
| ***A63B 22/16*** | (2006.01) |
| ***A63B 21/055*** | (2006.01) |
| ***A63B 21/018*** | (2006.01) |
| ***A63B 22/18*** | (2006.01) |
| *A63B 21/02* | (2006.01) |
| *A63B 21/04* | (2006.01) |
| *A63B 21/00* | (2006.01) |
| *A63B 23/035* | (2006.01) |
| *A63B 23/04* | (2006.01) |
| *A63B 69/06* | (2006.01) |
| *A63B 22/00* | (2006.01) |

(52) U.S. Cl.

CPC ..... *A63B 22/16* (2013.01); *A63B 22/18* (2013.01); *A63B 23/03541* (2013.01); *A63B 21/023* (2013.01); *A63B 21/0442* (2013.01); *A63B 21/0557* (2013.01); *A63B 21/154* (2013.01); *A63B 21/4035* (2015.10); *A63B 23/03525* (2013.01); *A63B 23/0405* (2013.01); *A63B 2022/0033* (2013.01); *A63B 2069/068* (2013.01); *A63B 2208/0204* (2013.01); *A63B 2208/0214* (2013.01); *A63B 2208/0228* (2013.01); *A63B 2208/0242* (2013.01); *A63B 2210/50* (2013.01)

(58) Field of Classification Search

CPC . A63B 22/4035; A63B 22/154; A63B 22/023; A63B 22/0442; A63B 22/0552; A63B 22/0557; A63B 2022/0033; A63B 2210/50; A63B 23/03541; A63B 23/03525; A63B 23/0405; A63B 21/02; A63B 21/0442; A63B 21/0428; A63B 21/05; A63B 21/4033; A63B 21/4034; A63B 21/4047; A63B 2022/0092; A63B 2022/003; A63B 69/0066

See application file for complete search history.

(56) References Cited

U.S. PATENT DOCUMENTS

| | | | | | |
|---|---|---|---|---|---|
| 4,664,445 | A | | 5/1987 | Groseth | |
| 4,749,180 | A | * | 6/1988 | Boomer | A63B 69/0093 434/247 |
| 4,871,208 | A | | 10/1989 | Hodgdon | |
| 4,966,364 | A | * | 10/1990 | Eggenberger | A63B 69/0093 482/146 |
| 5,062,629 | A | * | 11/1991 | Vaughan | A63B 22/18 482/147 |
| 5,318,488 | A | | 6/1994 | Babcock | |
| 5,342,266 | A | * | 8/1994 | Dailey | A63B 69/187 482/146 |
| 5,429,562 | A | * | 7/1995 | Milner | A63B 22/18 482/142 |
| 5,509,871 | A | * | 4/1996 | Giovanni | A63B 69/0093 482/30 |
| 5,582,567 | A | * | 12/1996 | Chang | A63B 22/16 482/132 |
| 5,649,740 | A | | 7/1997 | Hodgdon | |
| 6,176,548 | B1 | | 1/2001 | Thole et al. | |
| 6,676,579 | B1 | * | 1/2004 | Lin | A63B 22/0012 482/146 |
| 7,094,183 | B2 | * | 8/2006 | Hsieh | A63B 22/18 482/123 |
| 7,452,314 | B2 | | 11/2008 | Mills et al. | |
| 7,625,323 | B1 | * | 12/2009 | Lin | A63B 21/015 482/112 |
| 7,670,265 | B1 | | 3/2010 | Forrest et al. | |
| 7,686,751 | B2 | * | 3/2010 | Carlson | A63B 69/0066 482/146 |
| 7,803,096 | B2 | * | 9/2010 | Mehta | A63B 22/14 482/112 |
| 7,806,479 | B2 | | 10/2010 | Jensen et al. | |
| 2008/0103034 | A1 | | 5/2008 | Mihara et al. | |

FOREIGN PATENT DOCUMENTS

| | | | |
|---|---|---|---|
| GB | 2443395 | A1 | 5/2008 |
| WO | 2013/159146 | A1 | 10/2013 |

OTHER PUBLICATIONS

Product summary, "The Vasa Trainer", (Online) Jan. 20, 2012, (retrieved on Sep. 7, 2013), retrieved from the internet <URL: http://web.archive.org/web/20120120142135/h ttp://swimming.about.com/library/weekl ylaapr_vasa.htm>.

International Search Report, dated Jul. 4, 2013, for PCT App. No. PCT/AU2013/000423 (4 pages).

International Preliminary Report on Patentability, dated Oct. 28, 2014, for PCT App. No. PCT/AU2013/000423 (7 pages).

EPO Machine Translation of Abstract, DE102009033440, dated Apr. 6, 2016 (2 pages).

Extended European Search Report for European Patent Application No. EP 13 78 2258 dated Feb. 12, 2015 (8 pages).

First Examination Report for New Zealand Patent Application No. 701336 dated Feb. 20, 2015 (4 pages).

* cited by examiner

SECTION A-A

SECTION B-B

SECTION C-C

DETAIL E
SCALE 1 : 1

DETAIL F
SCALE 1 : 2

EXERCISE/TRAINING MACHINE

CROSS-REFERENCE TO RELATED APPLICATIONS

The present application claims priority from Australian Provisional Patent Application No 2012901612 filed on 24 Apr. 2012, the content of which is incorporated herein by reference and is a continuation-in-part of PCT/AU2013/000423 filed on 23 Apr. 2013.

FIELD OF THE INVENTION

This invention relates to an exercise/training machine, and in particular to a machine that can be used to train surfers but which can also be used in other applications for exercise, strength training including core strength, cardio-vascular fitness, balance and the like.

BACKGROUND OF THE INVENTION

There are many different types of exercise machine available on the market which promise fitness and health benefits if used properly including treadmills, stationary cycles, cross-trainers, rowing machines and the like. Devices such as the "Bosu" and exercise balls are also commonly used to provide exercises to improve a person's balance and core strength.

A number of exercise machines have been proposed that are more specifically directed to water sports including, for example, swimming training machines. Such machines are typically unsuited to training surfers and while they do provide some exercise benefits if used correctly, do not typically improve a person's core strength or balance and are usually quite limited in the exercises that can be performed using the devices.

Surfing is a popular sport in Australia and elsewhere. However surfers need to understand the ocean and how to ride waves to be successful. Particular muscles are used. It is a major challenge for surfers to get and maintain surf fitness so that when the waves are good, they can take advantage of them.

This is a particular issue for novice and trainee surfers, and surf schools which rely on good easy conditions to teach beginners to surf. As the ocean can be dangerous, many surf instructors can spend more time ensuring the safety of their students than teaching them to surf.

It would be advantageous therefor to provide an exercise/training machine that can successfully provide a workout for surfers, that could be used to teach novice surfers and which may advantageously also be used as general exercise device to improve a user's fitness and strength, particularly paddle fitness and core strength, but which can also provide health and fitness benefits for non-surfers.

Any discussion of documents, acts, materials, devices, articles or the like which has been included in the present specification is not to be taken as an admission that any or all of these matters form part of the prior art base or were common general knowledge in the field relevant to the present disclosure as it existed before the priority date of each claim of this application.

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps.

SUMMARY OF THE INVENTION

In a first broad aspect of the present invention there is provided an exercise/training device comprising:

- a platform on which a user may kneel, sit, lie, stand or the like in use;
- a support frame on which the platform is mounted, the support frame including legs for supporting the top of the frame above ground level;
- a rod or other similar member mounted on the support frame and extending away from the platform and at least one resistance means such as a pulley or the like and a handle or the like, provided on the rod, which can be grasped by a user and pulled against a resistance and
- wherein the platform is mounted on the support frame by means of a mounting which allows the platform to tilt, particularly laterally from side to side about an axis which is parallel or co-axial to the axis of the rod.

The mount may also allow longitudinal tilting, although typically this will be more limited than the lateral tilting.

Preferably the mounting is adjustable to allow the degree of instability of the platform to be adjusted and controlled.

In one embodiment, the resistance may be provided by a pulley or the like and springs.

In an alternative embodiment, the resistance may be provided by stretchable cords or elastomeric materials such as shock cords.

In one embodiment, where a pulley and springs are used, a series of pulley wheels may be provided to change the mechanical advantage and thereby alter the resistance to movement of the handle. This enables the device to operate smoothly and allows for three dimensional movement patterns of the user's arms.

The rod is preferably adjustable in length, typically telescopically, to move the pulley towards or away from the platform to provide adjustment to suit the user.

The platform will typically be in the shape or form of a surfboard, or simulation thereof.

Advantageously, the platform may be moveable/collapsible between an elevated position, typically about 400 to 600 mm above ground and a lowered/collapsed position, typically by movement of the legs.

To enable this, the legs may be pivotally mounted to the top of the support frame, an arranged so that they cam be positioned at an angle of about 100° to the top of the support frame in the elevated position and general parallel to and contiguous with the top of the support frame in the lowered position.

Stabilisers may be provided and deployed when the support frame is in the lowered position.

Advantageously, the device may be used for exercise in both positions, with the higher position being used for e.g. simulating paddling and the lower position for e.g. doing squats. The collapsed position may also be used for storage/transportation of the device.

Advantageously, the present invention may provide an exercise device that can be used to simulate the experience of paddling a surfboard due to the adjustable instability of the mount, while at the same time providing a full body resistance workout and cardio-vascular workout on a variable/unstable platform which also provides core strength benefits.

In addition to the resistance means for a user's arms, a leg press may also be provided at or spaced from the opposite end of the platform to the pulley and handles. A bar may be provided which can be moved (e.g. pushed away) by the user's legs against a resistance means similar to the first resistance means. The bar may also be stationary. It is also envisaged that a mechanism could be provided to allow for translational (forwards and backwards) movement of the platform and/or rotational (spinning) movement about a vertical axis. Where such movement is possible, locking means may be provided to disable it temporarily.

In a second aspect of the present invention there is provided an exercise/training device comprising:— a platform on which a user may lie or stand in use;

a support frame on which the platform is mounted, the support frame including legs for supporting the top of the frame above ground level;

wherein the platform is mounted on the support frame by means of a mounting which allows the platform to tilt, particularly from side to side about an axis which is parallel or co-axial to the axis of the rod; and including means for controllably adjusting the degree of instability of the mounting of the platform to the support frame to control the forces required to tilt the platform.

Typically the instability is provided by shaped elastomeric elements sandwiched between two outer plates either side of a central plate. The assembly may be held together by compressing the components together with a bolt or the like. The outer plates may be attached to the platform. The elastomeric elements may be generally U-shaped having a base and projections. The degree of instability of the mounting of the platform may be accurately controlled by compressing the assembly and in particular the elastomeric elements. The greater the compression, the more stable the mounting. Compression may be provided by a simple threaded nut and bolt arrangement or by a ratchet based system.

BRIEF DESCRIPTION OF THE DRAWINGS

A specific embodiment of the invention will now be described, by way of example only, in which:—

DETAILED DESCRIPTION OF PREFERRED EMBODIMENTS

Figure 1:
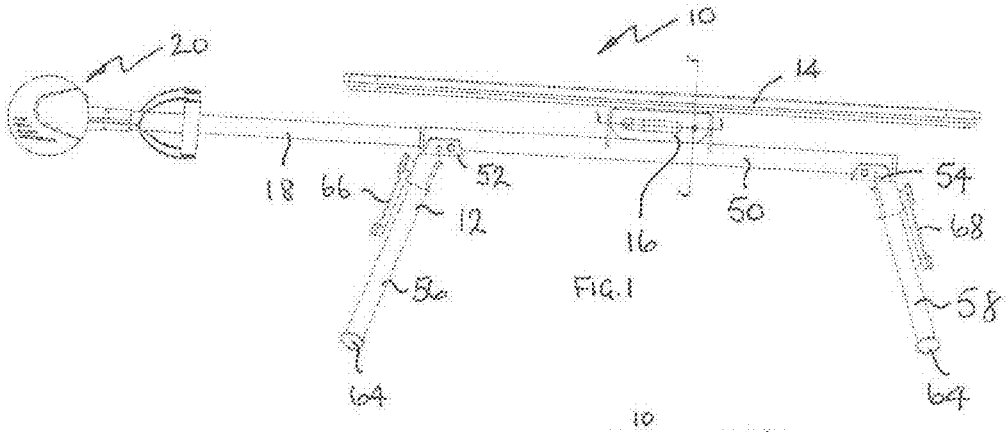
FIG. 1 is a side view of an embodiment of an exercise/training device.

Referring to the drawings, FIG. 1 shows an exercise/training device 10 which is particularly suited for use as a surf trainer and for attaining and maintaining surf fitness. The device includes a support frame 12, on top of which is mounted a platform 14, shaped like a surfboard, via a mounting 16 which provides instability, described in more detail below. A rod 18 extends to one side of the support frame on the end of which is mounted a pulley arrangement 20 as a part of a resistance means, described in more detail below.

Figure 7:
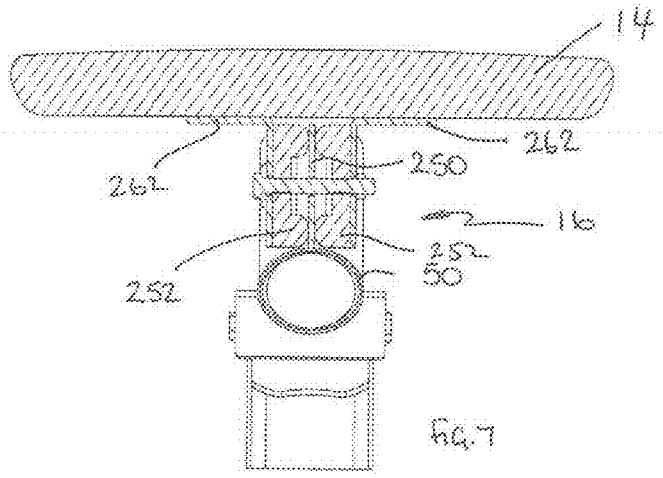
FIG. 7 is a section on A-A shown in FIG. 1.

The support frame 14 includes an upper bar 50 having a generally oval cross-section (best illustrated in FIG. 7). At either end of the bar there are brackets 52, 54 to each of which a leg 56, 58 is pivoted. As shown each leg 56, 58 is oriented at an angle of about 100° to the upper bar. Stops 60, 62 are provided to maintain the angle of the legs to prevent the frame from collapsing. The rear leg 58 is slightly shorter than the front leg 56, so that in use the surfboard/platform slopes downwards to the rear. At the base of each leg there is a foot in the form of a cross-piece 64 to provide stability when the device is in an elevated position as shown in FIG. 1.

A pair of arms 66, 68, which are about half the length of the leg, are pivotally mounted to the top of each leg. In certain embodiments these may be omitted.

Figure 2:
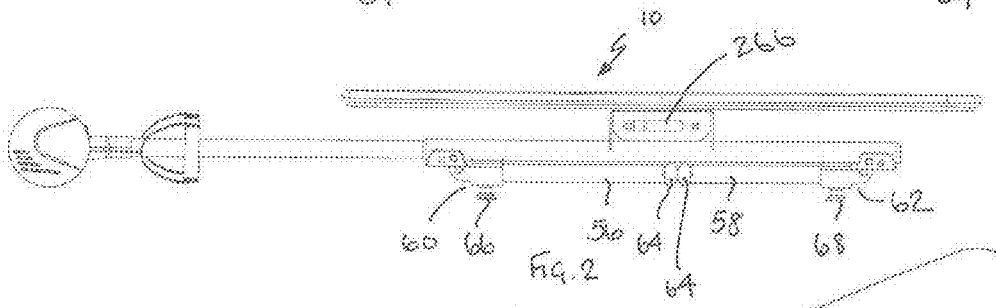
FIG. 2 is a side view of the device shown in FIG. 1 in a collapsed/lowered position.
Figure 4:
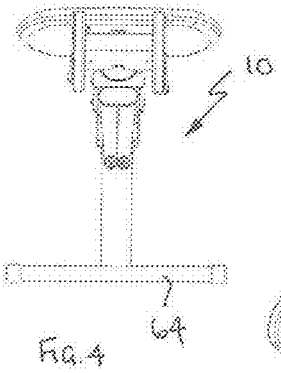
FIG. 4 is an end view of the device shown in FIG. 1.
Figure 3:
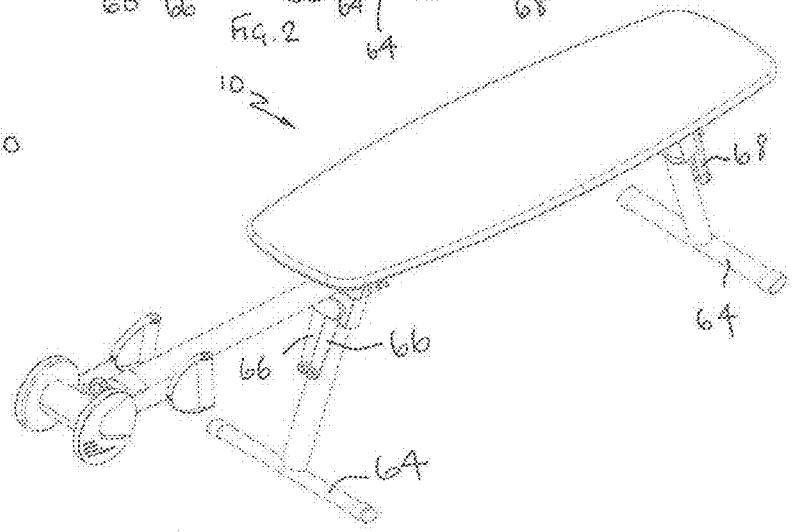
FIG. 3 is an isometric view of the device shown in FIG. 1.
Figure 6:
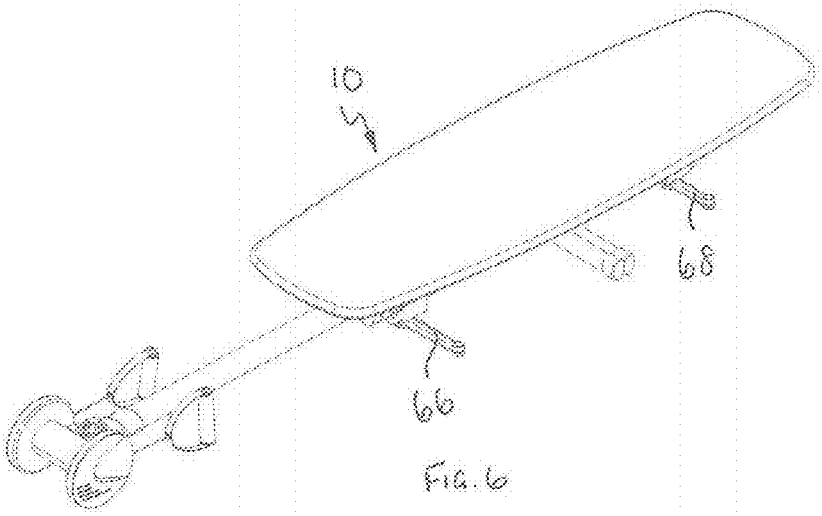
FIG. 6 is an isometric view of the device shown in FIG. 1 in a collapsed/lowered position.

The frame may be used in an elevated position, as shown in FIG. 1, or be lowered/folded for storage or used at a lower level for e.g. standing exercises such as squats, as shown in FIGS. 2 and 6, in which case the arms 66, 68 are extended outwards to provide stability for the support frame.

As shown in FIG. 1, the rod 18 is telescopically mounted within the upper bar 50 of the support frame. The pulley arrangement 20 is mounted at the distal end of the rod. The pulley arrangement is shown in more detail in FIGS. 12 to 20. The pulley arrangement includes two relatively large diameter pulleys 102, 104, having covers 105. The large pulleys are fixed on respective shafts 106, 108 each of which define three pulley wheels of decreasing size, 110, 112 and 114. The two shafts are not connected and move independently of one another. A cord 116, 118 is fixed to each large pulley, wrapped around it several turns and extends away to a handle/grip 120. Pulling on the handle turns the large pulley about its axis turning its respective shaft and pulley wheels 110-114.

Figures 18, 19, 20:
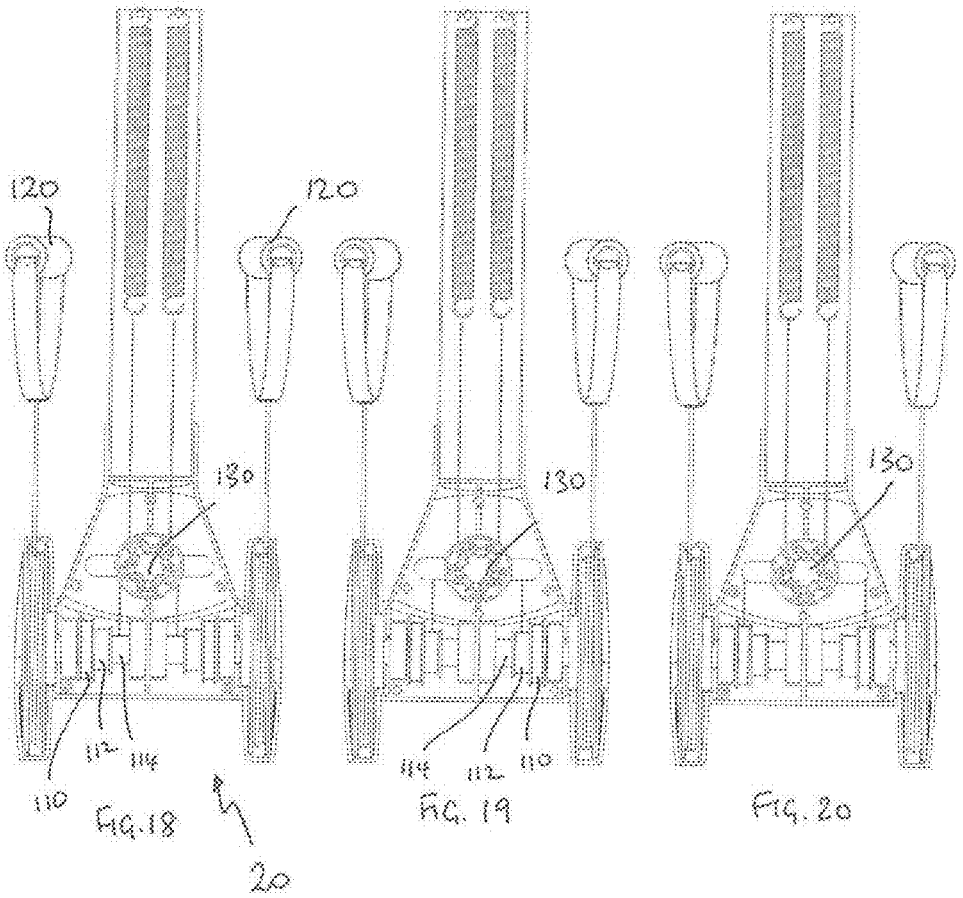
FIGS. 18 to 20 show the pulley based resistance means set to provide differing levels of resistance.
Figures 21, 22:
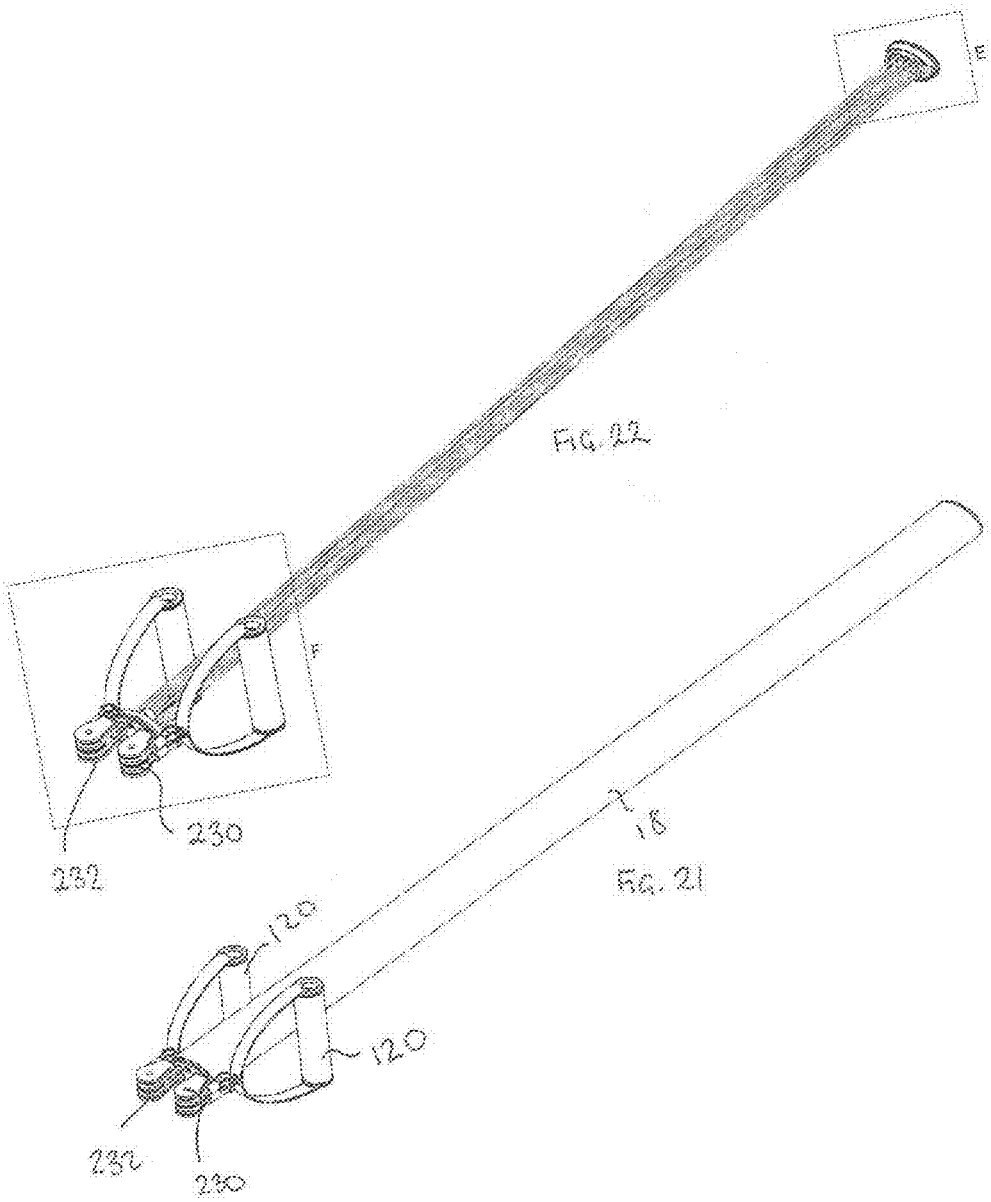
FIG. 21 schematically illustrates an alternative way of providing resistance using "shock cord"
FIG. 22 illustrates the "shock cords" and hand grips.
Figure 24:
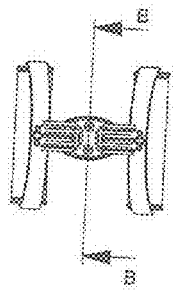
FIG. 24 is an end view of the arrangement shown in FIG. 21.
Figure 23:
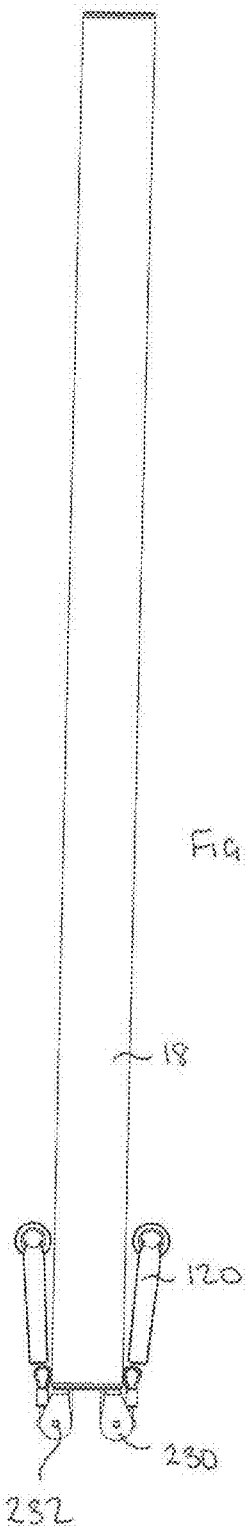
FIG. 23 is a plan view of the arrangement shown in FIG. 21.
Figure 25:
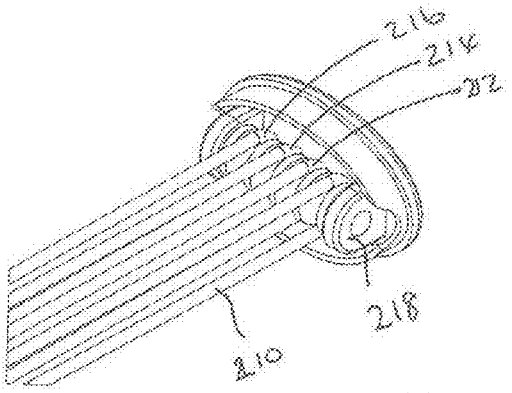
FIG. 25 is a detail on "E" shown in FIG. 22.
Figure 26:
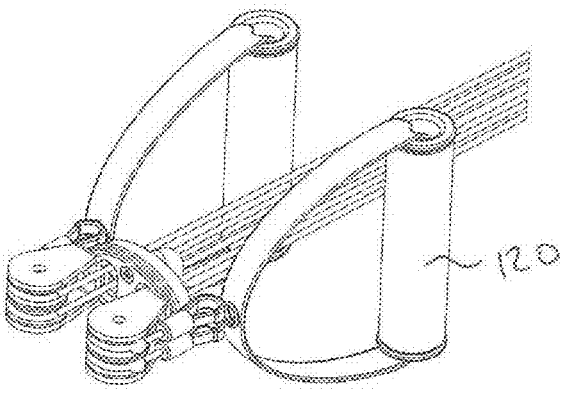
FIG. 26 is a detail on "F" shown in FIG. 22.
Figure 27:
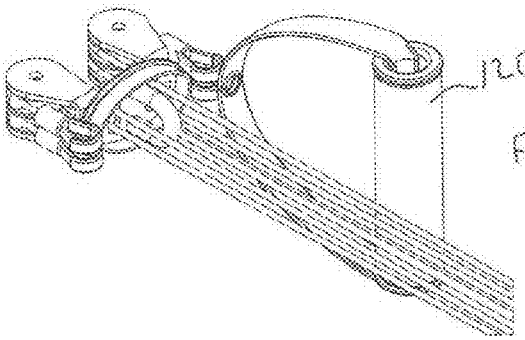
FIG. 27 is a detailed view similar to FIG. 26 but from a reverse angle.
Figures 28, 29, 30:
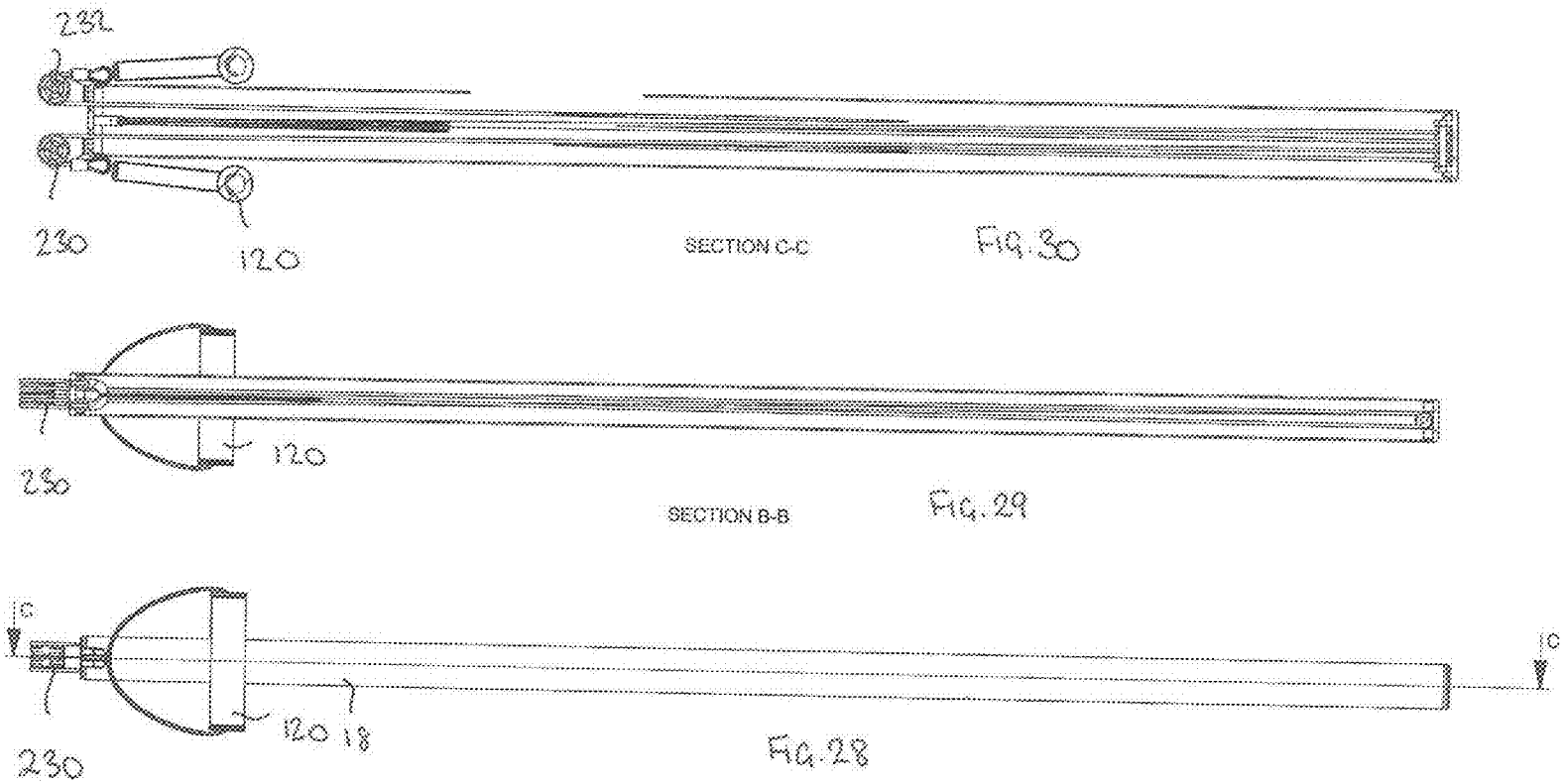
FIG. 28 is a side view of the arrangement shown in FIG. 21.
FIG. 29 shows a section on B-B shown in FIG. 28.
FIG. 30 shows a section on C-C shown in FIG. 28.
Figure 31:
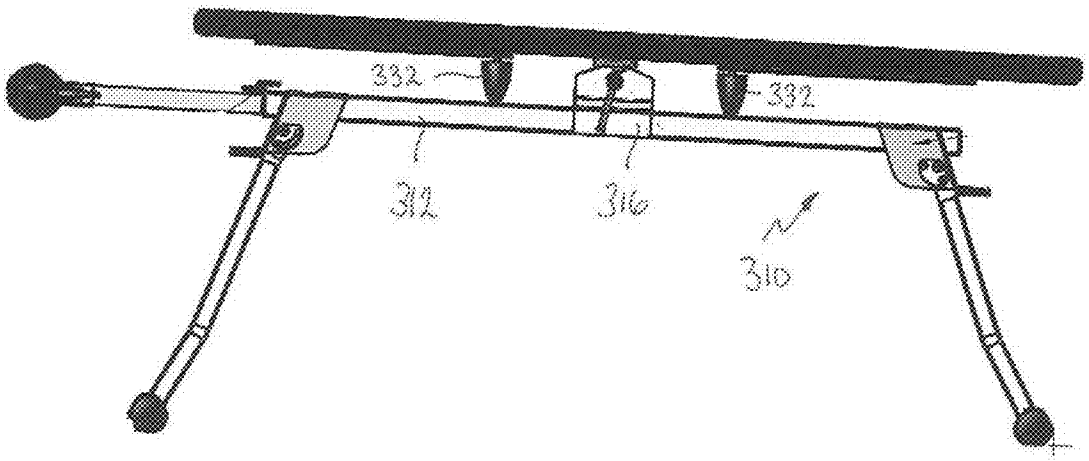
FIG. 31 shows a variant of the exercise trainer incorporating a variant of the instability assembly.

Resistance to movement of the pulley/cord is provided by two springs 122, 124, which are connected by cord or wire to the one of the pulleys 110, 112 or 114. the springs are housed in the rod 18 and/or upper bar 50 of the frame. A switching mechanism 130 is provided to run the cord around as is best shown in FIGS. 18 to 20. It will be appreciated that there is a mechanical advantage in converting the rotation of the large pulley wheels 102, 104, to a rotation of one of the smaller pulleys. The different pulleys 110, 112, 114 provide different levels of resistance, with the smallest pulley 114 providing the least resistance to pulling on the handles 120 and the largest pulley 110, the most.

In a variant (not illustrated) additional resistance means for a user's legs, such as a leg press may also be provided at or spaced from the opposite end of the platform to the pulley and handles. A bar is provided which can be moved (e.g. pushed away) by the user's legs against a resistance means similar to the first resistance means. In a variant discussed below, where the platform is able to move backwards and forwards on the frame, the bar may be fixed.

Figure 8:
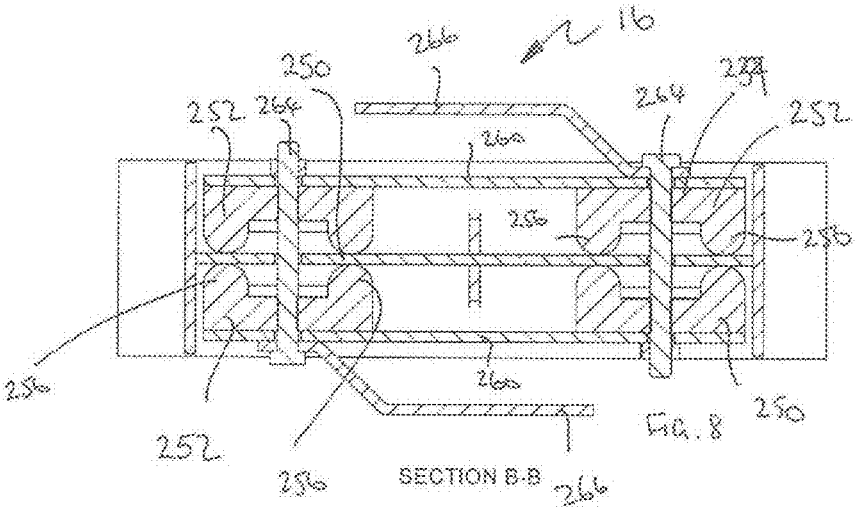
FIG. 8 is a section on B-B shown in FIG. 1.
Figure 9:
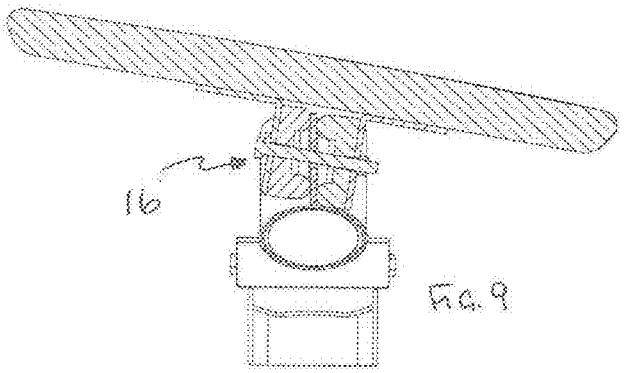
FIG. 9 is a section on C-C shown in FIG. 5.

The assembly 16 by which the platform is unstably mounted to the support frame is best illustrated in FIGS. 7 to 9. In the centre there is a first metal plate 250. Located on either side of the central plate 250 are two pairs of two elastomeric/rubber elements 252. Each elastomeric element has a generally channel shaped cross-section having a flat base 254 and two rounded projections 256 which extend from the ends of the base. The elastomeric elements are arranged in opposed pairs either side of the plate with the projections facing and contacting the plate. A washer plate 258 locates in the gap between the projections of each element 252. Two further outer plates 260 sandwich the elements 252. The plates 260 are bent to define sections 262 at 90° to the plate for fixing the plates to the underside of the platform 14. The assembly is held together by bolts 264 which extend through the three plates and through the centres of each opposed pair of elastomeric elements. The instability of the mounting is provided by deformation of the elastomeric elements. The degree of resistance to deformation can be controlled by moving the outer plates 260 together and compressing the elastomeric elements using levers 266 which tighten the bolts 264. In an alternative embodiment, not shown, the elastomeric elements may be compressed by a ratchet system illustrated in more detail in FIGS. 40 to 42.

Figure 10:
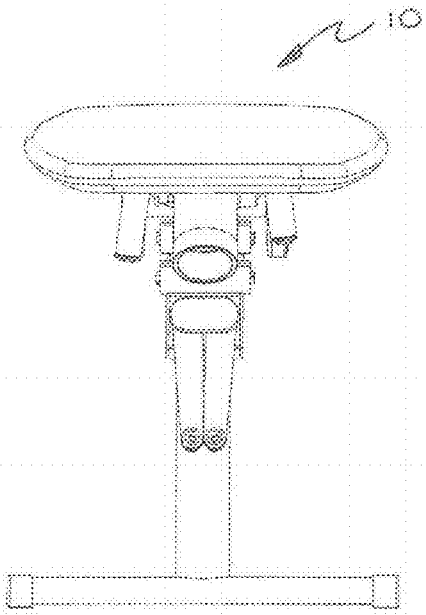
FIG. 10 is a rear end view of the device of FIG. 1
Figure 11:
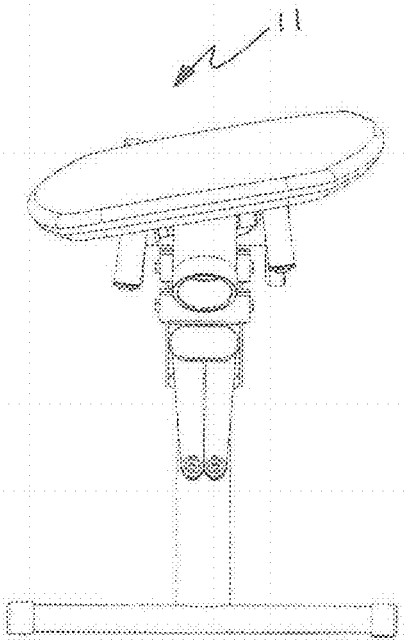
FIG. 11 is a rear end view of the device of FIG. 1 showing a platform/board on top of the device tilted to one side.
Figure 12:
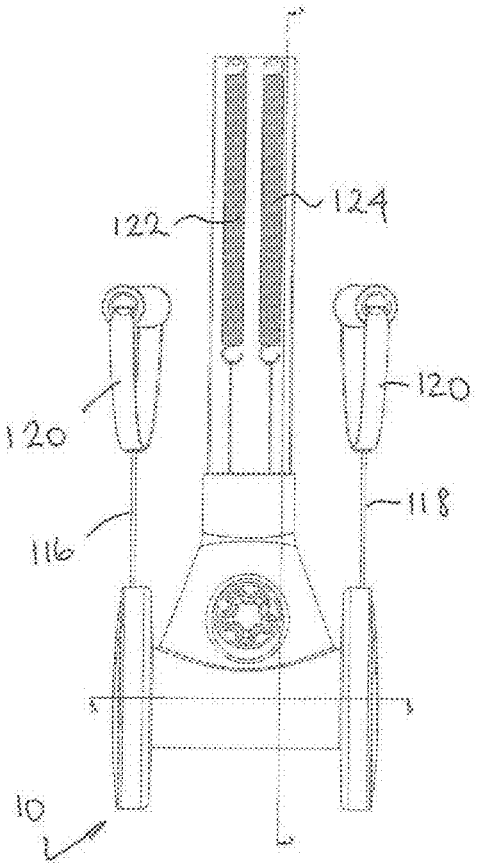
FIG. 12 is a top plan view of a pulley based resistance means of the device with a cover removed to show a pair of springs.
Figure 13:
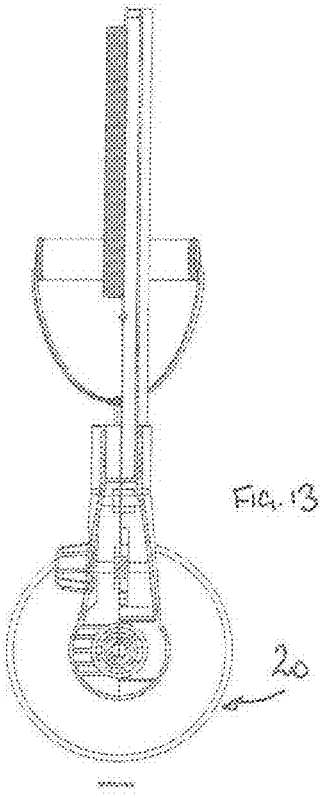
FIG. 13 is a section on B-B shown in FIG. 12.
Figure 14:
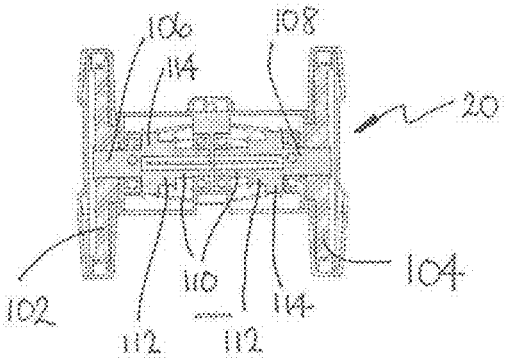
FIG. 14 is a section on A-A shown in FIG. 12.
Figure 15:
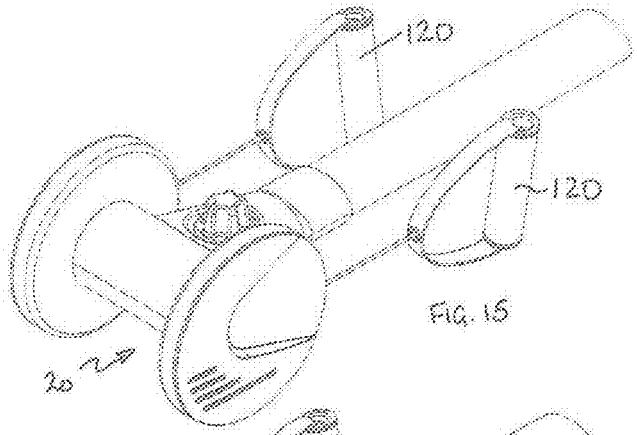
FIG. 15 is an isometric view of the pulley based resistance means shown in FIG. 12.
Figure 16:
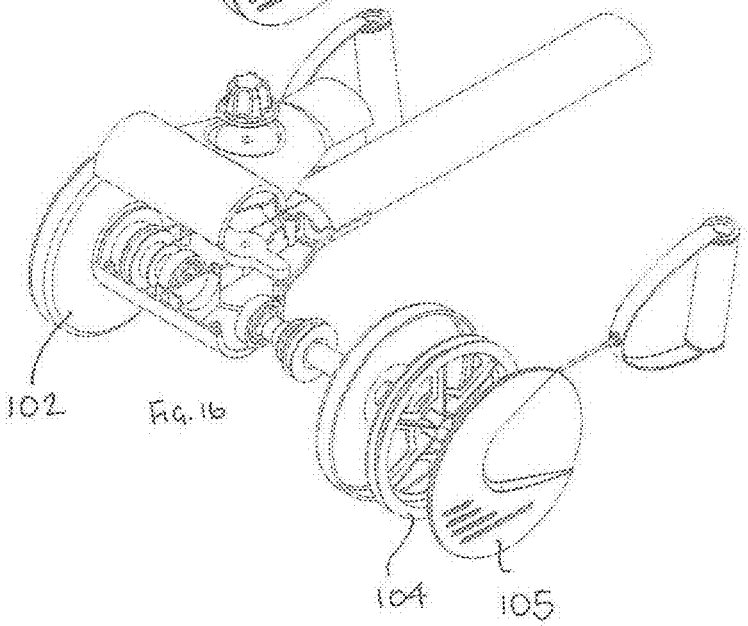
FIG. 16 is a part exploded view of the pulley based resistance means shown in FIG. 15.
Figure 17:
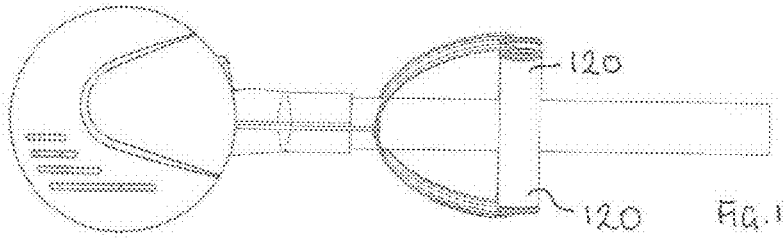
FIG. 17 is a side view of the pulley based resistance means shown in FIG. 15.

In use, as illustrated by comparing FIGS. 10 and 11 in particular, the platform can move/rock from side to side providing instability while resistance to movement of one's arms is provided by the pulley assembly so can be used to simulate paddling on a surfboard for training and/or general exercise. The device can also be used to simply provide instability, without using the pulley assembly. It will be appreciated that many different exercises can be carried out using the device and the device is not limited to use for the exercises described herein.

FIGS. 21 to 30 illustrate a variant of the invention in which the pulley assembly and springs are replaced with stretchable cords 200 (sometimes known as "shock cords") to provide resistance to movement of the handles/grips 120. In this embodiment four (two pairs of two) shock cords 210, 212, 214, 216 having different degrees of resistance to stretching have one end fixed near the end the tube 18 which is nearest the handles 120 and extend inside the tubes 18 and 50 to an array of pulleys 218 and back to the handle end of the tube around further arrays of pulley wheels 230, 232 either side of the tube for subsequent connection to one of the two handles 120. The end of each of the four cords has a clip 220 for attaching it to a handle 120. Each handle can be connected to either one of the two cords or both of them. As the cords provide differing resistance to stretching, that provides for three different resistance levels.

Figure 32:
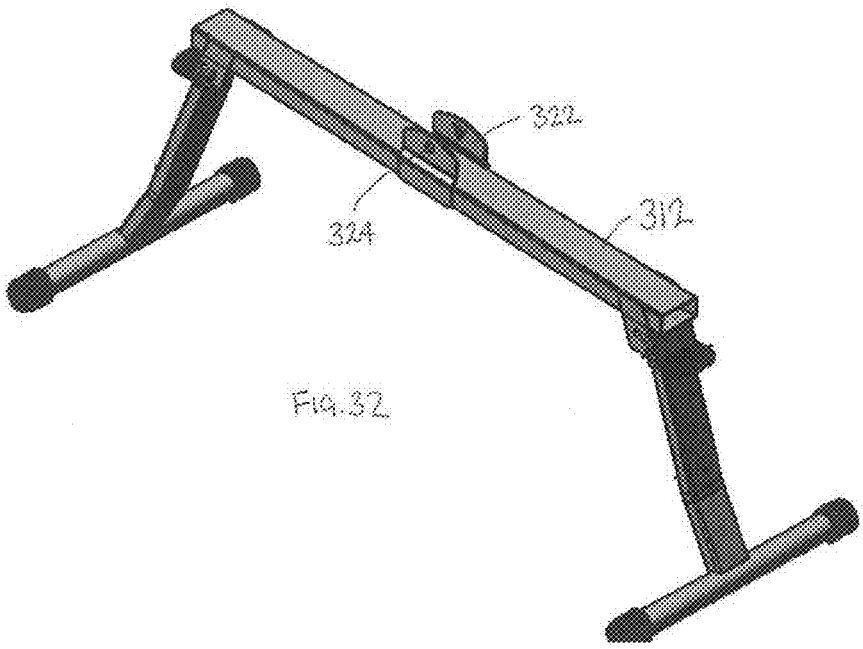
FIG. 32 shows the frame of the variant of FIG. 31.
Figure 33:
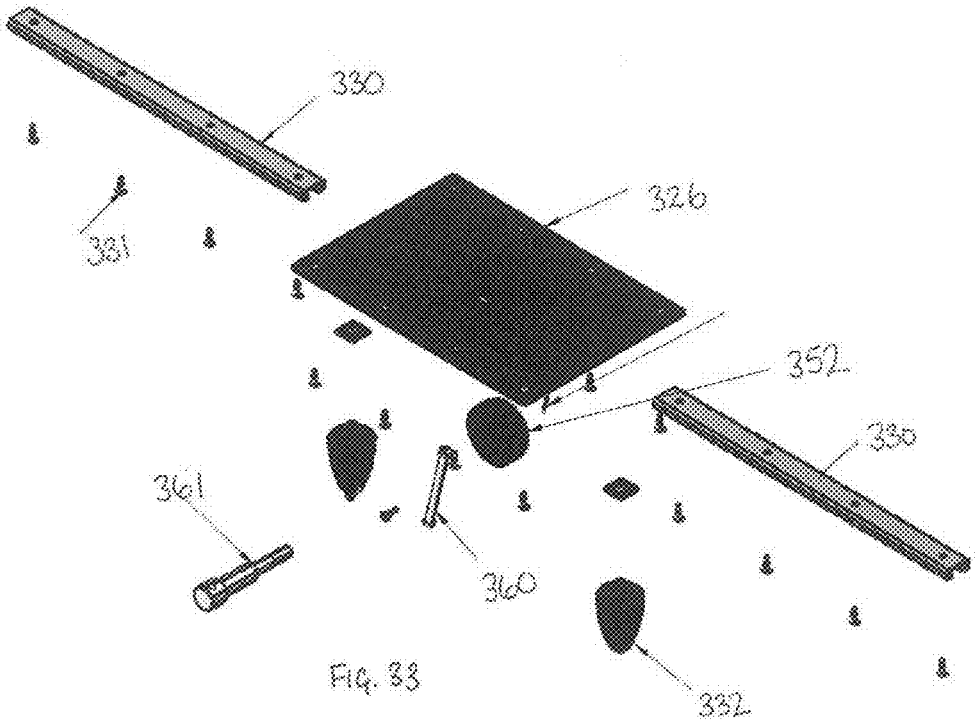
FIG. 33 shows an exploded view of the components of part of the instability assembly.
Figure 34:
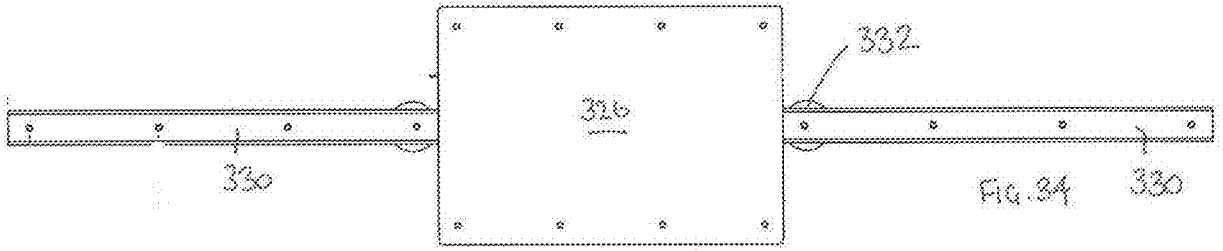
FIG. 34 is a top plan view of part of the instability assembly.
Figure 36:
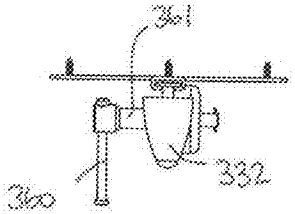
FIG. 36 is an end view of part of the instability assembly shown in FIG. 34.
Figure 35:
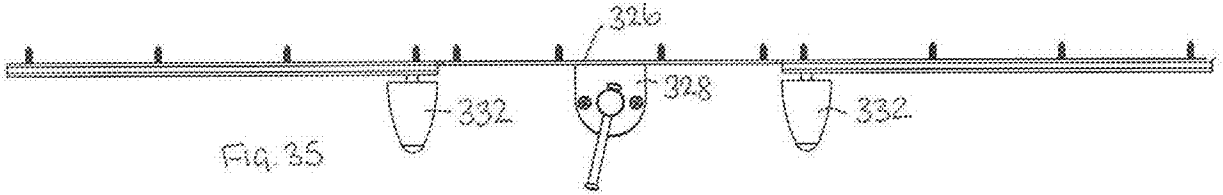
FIG. 35 is a side view of part of the instability assembly shown in FIG. 34.
Figure 37:
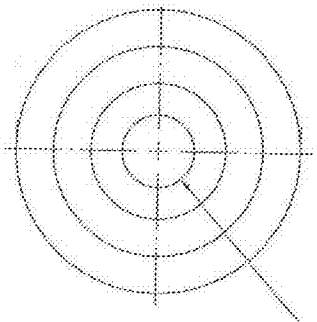
FIGS. 37 to 39 show a plan view, side view and a section through a rubber bushing forming part of the instability assembly.
Figure 38:
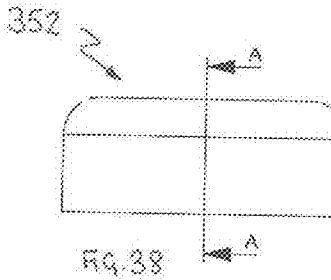
Figure 39:
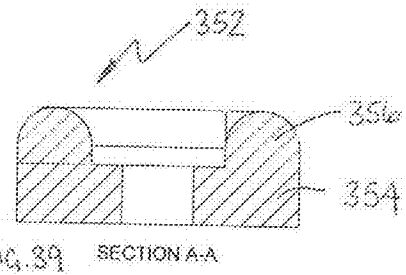

FIGS. 31 to 39 illustrate a variant of the trainer 310 including a variant 316 of the instability assembly. The assembly includes a central adjustable fitting 318 and two supporting elastomeric cones 320 spaced either side of the central fitting along the length of the frame 312. As is best shown in FIG. 32, two vertical plates 322 are welded to either side of the top of the frame. Each plate defines an aperture 324.

FIGS. 33 to 36 illustrate the part of the instability assembly that attaches to the platform 14. In particular there is a rectangular plate 326 from which depends a semi-circular relatively perpendicular plate 328. Two tracks 330 extend away from either end of the plate 326. The assembly is mounted to the underside of the platform 10 using screws 331. Two flexible elastomeric cones 332 with rounded ends are mounted in the tracks and can be moved along the tracks to adjust the stability of the mounting and the degree of pitch possible. In a variant (not shown) the cones could be mounted to the frame with their tips pointed upwards. This has the advantage that they are less likely to lose contact with the platform which has a larger surface area than the top of the frame. The cones may be fixed or mounted on a track and moveable.

A rubber bushing 352 having a circular base 354 and raised perimeter 356 having a rounded end/top is sandwiched between one plate 322 and the depending plate 328 and compressed using a handle 360 and shaft 361 drawing the plates together. The more the bushing is compressed the more rubber contacts the plate 322 and the more stability is provided.

Figure 5:
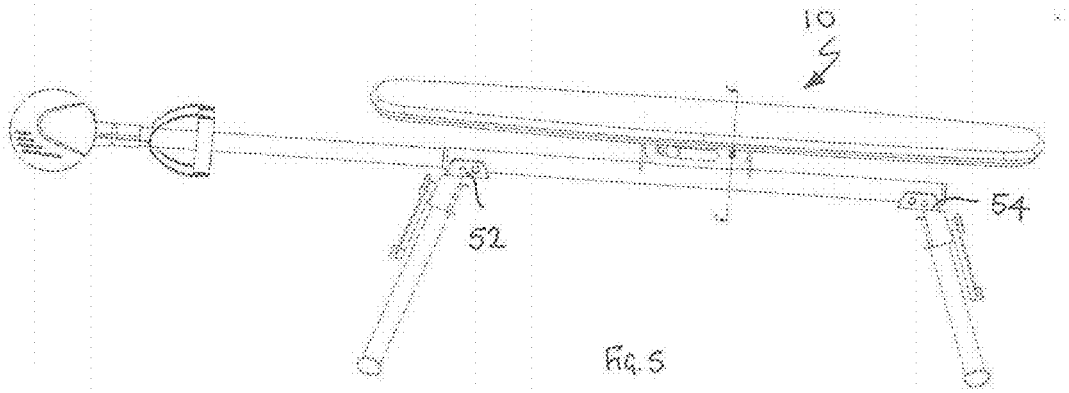
FIG. 5 is a side view of the device shown in FIG. 1 showing a platform/board on top of the device tilted to one side.
Figure 40:
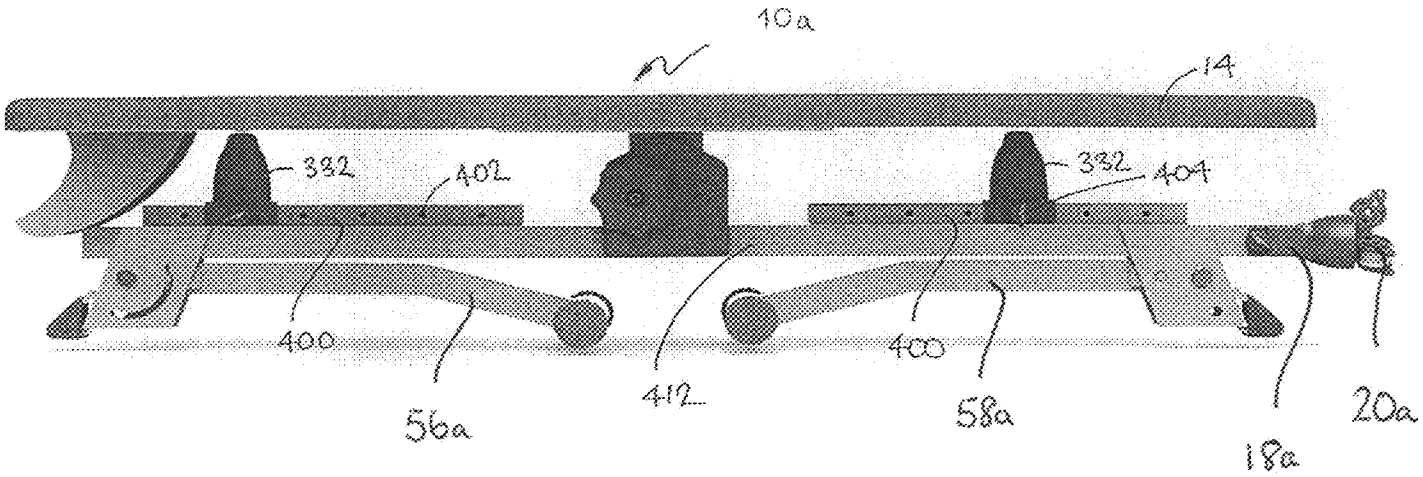
FIG. 40 is a side view of a yet further variant of an exercise trainer.
Figure 41:
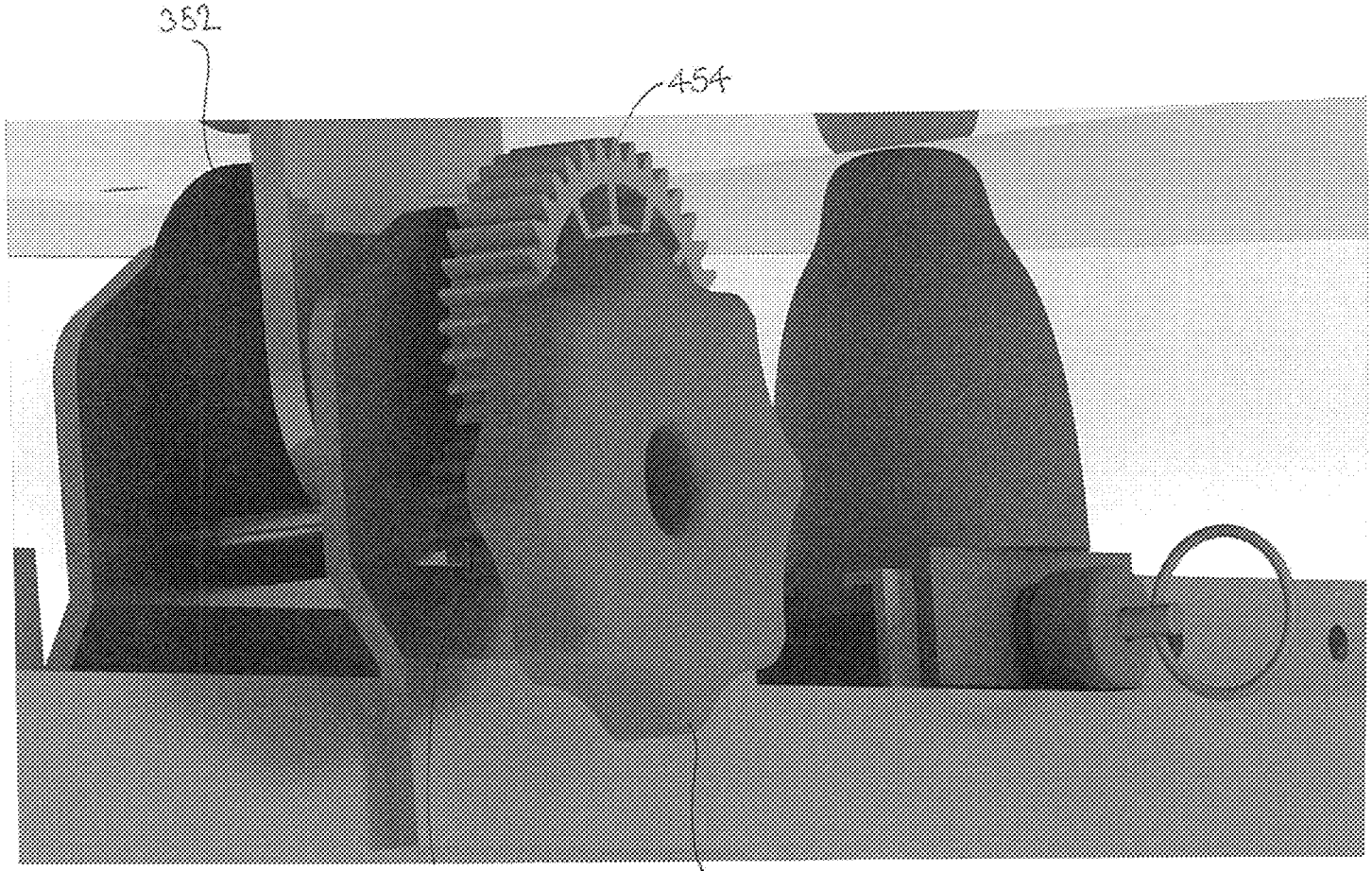
FIG. 41 is an enlarged view illustrating a ratchet based system for compressing the elastomeric instability assembly.
Figure 42:
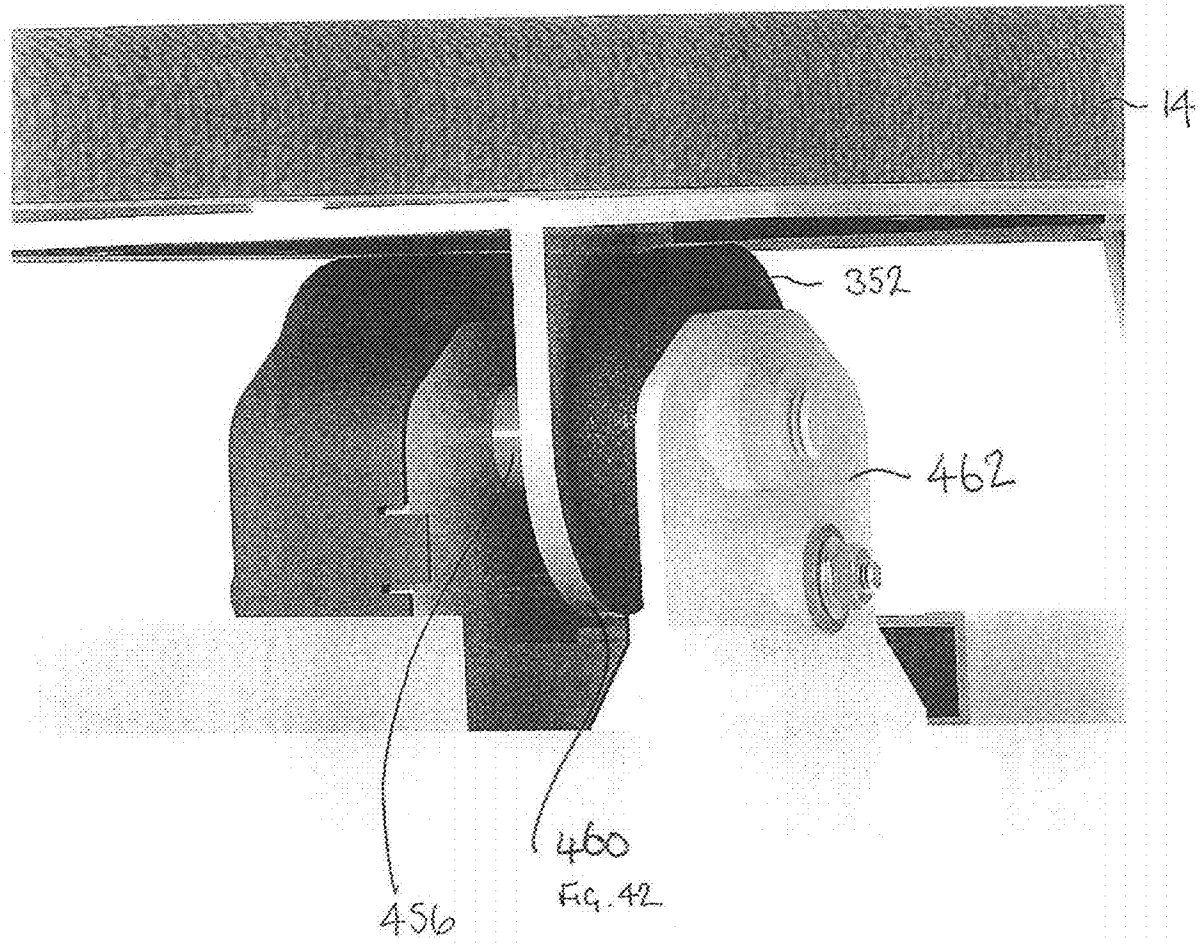
FIG. 42 is an enlarged view illustrating the ratchet based system for compressing the elastomeric instability assembly from an opposite side of the device.

FIGS. 40 to 42 show a further variant of an exercise/training machine 10*a*. FIG. 40 shows in particular the machine in a lowered state and flexible elastomeric cones 332 which are mounted on rails 400 which are located on top of the support frame 412. The narrow ends of the cones face upwards and contact the underside of the platform 14. As shown the rails 400 define a series of spaced through holes 402 positioned along the rail to which the cones may be secured using a pin 404. The pin may be removed to move the cone closer or towards the centre of the platform to adjust the instability of the platform and inserted in a different hole. The Figures also show the legs 56*a*, 58*a*, extendible rod 18*a* (shown in a retracted position) and pulley 20*a* to provide a resistance. As with the embodiment shown in FIGS. 5 and 6, the legs 56*a* and 58*a* can be positioned to lie generally parallel to ground as shown in FIG. 40 for storage or used at a lower level for e.g. standing exercises such as squats.

FIGS. 41 and 42 in particular illustrate a geared ratchet based system for 15 adjusting the instability of the mounting. In particular a handle/wheel 450 turns a coaxial small toothed cog 452 which meshes with a larger diameter toothed wheel 454 which in turn compresses or de-compresses the elastomer by turning an axial threaded rod 456 either clockwise or anti-clockwise. The toothed wheels provide a mechanical advantage which allows the elastomer to be compressed with less torque applied to the handle. FIGS. 41 and 42 also show plates 460 and 462 between which the elastomer is mounted. The embodiment of FIGS. 40 to 42 may use the same handle 120 as is shown in FIGS. 26 to 30.

Other variants are possible. For example it is envisaged that the platform may be attached to the base in such a manner that it can travel backwards and forwards. There are a number of ways that this can be achieved, for example by the use of a channel or channels and rollers disposed between the bottom of the assembly 16 and the support frame. Rollers could be mounted to the sides of the assembly 16 and run along the channel or channels. It is also envisaged that in a further variant that the assembly could be mounted to the support frame via a turntable to allow the platform to spin through 360°. Locking means could be provided to permitting or preventing spin/forward and backwards movement as required.

It will be appreciated by persons skilled in the art that numerous variations and/or modifications may be made to the above-described embodiments, without departing from the broad general scope of the present disclosure. The present embodiments are, therefore, to be considered in all respects as illustrative and not restrictive.

The invention claimed is:

1. An exercise/training device comprising:

a platform on which a user may kneel, sit, lie, or stand when in use;

a support frame on which the platform is mounted, the support frame including legs for supporting the top of the frame above ground level;

a rod mounted on the support frame and extending away from the platform and at least one resistance element and a handle, provided on the rod, which can be grasped by the user and pulled against a resistance and;

wherein the platform is mounted on the support frame by an adjustable mounting which allows the platform to tilt, laterally from side to side about an axis which is parallel or co-axial to the axis of the rod and wherein the adjustable mounting includes at least one elastomeric element and is adjustable by compressing the element to allow the degree of instability of the platform to be adjusted and controlled; and further including two further elastomeric elements disposed on opposed sides of the adjustable mounting wherein the further elastomeric elements comprise cones and are mounted on tracks for movement towards and away from the mounting assembly for further adjustment of the stability of the device.

2. The exercise/training device as claimed in claim 1 wherein the elastomeric element is located between at least two plates, one connected to the platform and one to the support frame.

3. The exercise/training device as claimed in claim 2 wherein compression of the one elastomeric element is provided by a handle and meshing cogs to provide a mechanical advantage where turning of the handle turns a threaded rod which, when turned in one sense compresses the one elastomeric element by drawing the plates closer, and when turned in the opposite sense de-compresses the one elastomeric element by allowing the plates to move apart.

4. The exercise/training device as claimed in claim 2 wherein the two plates are oriented in a vertical plane in use.

5. The exercise/training device as claimed claim 1 wherein the platform is supported on legs which can be moved or adjusted to that the platform may be moveable/collapsible between an elevated position to a lowered/collapsed position relative to the elevated position.

6. The exercise/training device as claimed in claim 5 wherein the legs are pivotally mounted to the top of the support frame, an arranged so that they can be positioned at an angle of from about 110 to 90° to the top of the support frame in the elevated position and general parallel to and contiguous with the top of the support frame in the lowered position.

7. The exercise/training device as claimed claim 1 wherein the mount also permits longitudinal tilting.

8. The exercise/training device as claimed in claim 1 wherein the platform is in the shape or form of a surfboard.

9. The exercise/training device as claimed in claim 1 wherein the rod is adjustable to move the handle towards or away from the platform to provide adjustment to suit the user.

10. The exercise/training device as claimed claim 1 wherein the platform is supported on legs which can be oriented generally parallel to the platform in use or for storage.

11. An exercise/training device comprising:

a platform on which a user may lie or stand when in use;

a support frame on which the platform is mounted, the support frame including legs for supporting the top of the frame above ground level;

wherein the platform is mounted on the support frame by an adjustable mounting which allows the platform to tilt, particularly from side to side about an axis which is parallel or co-axial to the axis of the frame; and including means for controllably adjusting the degree of instability of the mounting of the platform to the support frame to control the forces required to tilt the platform wherein the instability is provided by the adjustable mounting assembly comprising at least one shaped elastomeric element sandwiched between two plates one of which is fixed to the support frame and one of which is fixed to the platform and wherein the assembly is held together by compressing the components together and further including two further elastomeric elements disposed on opposed sides of the adjustable mounting wherein the further elastomeric elements comprise cones and are mounted on tracks for movement towards and away from the mounting assembly for further adjustment of the stability of the device.

12. The exercise/training device as claimed in claim 11 wherein compression of the shaped elastomeric element is provided by a ratchet based system.

13. The exercise/training device as claimed in claim 11 wherein compression of the one elastomeric element is provided by a handle and meshing cogs to provide a mechanical advantage where turning of the handle turns a threaded rod which, when turned in one sense compresses the one elastomeric element by drawing the plates closer, and when turned in the opposite sense de-compresses the one elastomeric element by allowing the plates to move apart.

14. The exercise/training device as claimed in claim 11 wherein the two plates are oriented in a vertical plane in use.

15. The exercise/training device as claimed claim 11 wherein the platform is supported on legs which can be oriented generally parallel to the platform in use or for storage.

* * * * *